United States Patent [19]

Caswall, Jr. et al.

[11] 4,313,329

[45] Feb. 2, 1982

[54] UNLOADING APPARATUS

[75] Inventors: Robert D. Caswall, Jr.; George W. Kaase, both of Perrysburg, Ohio

[73] Assignee: Abbey-Etna Machine Company, Perrysburg, Ohio

[21] Appl. No.: 100,428

[22] Filed: Dec. 5, 1979

[51] Int. Cl.[3] ..... B21C 1/27; B21C 1/32; B21C 35/00

[52] U.S. Cl. ..... 72/290; 72/291; 72/257; 72/277; 414/745

[58] Field of Search ..... 72/290, 291, 287, 256, 72/277, 251, 257; 414/16, 14, 745; 198/782, 598, 489

[56] References Cited

U.S. PATENT DOCUMENTS

| | | | |
|---|---|---|---|
| 1,928,811 | 10/1933 | Burns | 72/251 |
| 2,279,340 | 4/1942 | Postlewaite | 414/745 |
| 2,453,401 | 11/1948 | Beeching | 198/782 |
| 2,663,411 | 12/1953 | Tschudnowsky | 414/16 |
| 2,914,170 | 11/1959 | Kent | 72/15 |
| 2,922,533 | 1/1960 | La Barge, Jr. | 414/745 |
| 3,181,334 | 5/1965 | Mattson et al. | 72/255 |
| 3,195,709 | 7/1965 | Physioc | 198/457 |
| 3,475,941 | 11/1969 | Groos et al. | 72/257 |
| 3,585,833 | 6/1971 | Carraher et al. | 72/257 |
| 3,739,619 | 6/1973 | Follrath et al. | 72/257 |
| 4,050,278 | 9/1977 | Asano et al. | 72/256 |

*Primary Examiner*—Daniel C. Crane

*Attorney, Agent, or Firm*—Wilson, Fraser, Barker & Clemens

[57] ABSTRACT

An axial discharge apparatus for use with a drawbench or an extrusion press includes a plurality of shiftable forks aligned for reception of drawn or extruded stock and a plurality of powered rollers disposed therebelow. The forks receive one or more lengths of drawn or extruded stock subsequent to the completion of forming and, in unison, lower them to the rollers. Rotation of the rollers conveys the formed stock axially out one end of the drawbench.

5 Claims, 4 Drawing Figures

UNLOADING APPARATUS

BACKGROUND OF THE INVENTION

The invention relates generally to metal forming equipment and specifically to apparatus for axially discharging stock from metal drawing and extrusion equipment.

The common metal forming techniques of drawing and extrusion involve the reduction of cross-sectional area of bar stock or the reduction of wall thickness of tube stock with an attendant increase in length as well as increased tensile strength due to the cold working of the metal inherent in such a process. In the extrusion process, stock being worked is forced toward and through a die effecting a reduction in cross-sectional area or wall thickness; whereas, the same effect is achieved in the drawing process by pulling or drawing the stock through the die.

Due to both the end use considerations and considerations of the time expended to complete the loading operation prior to each extrusion or drawing cycle versus the time required to complete the drawing operation, it is typical to perform the drawing or extruding operation over extended horizontal lengths to produce equally extended lengths of drawn or extruded metal stock. Finished lengths of fifty and sixty feet or more are not uncommon.

The production of such extended lengths of drawn or extruded material is accompanied by certain handling difficulties. In prior art extruding or drawing equipment, the finished stock is received by downwardly sloping, laterally extending arms which direct it laterally outwardly from the drawbench into a receiving bin. Such a discharge structure exhibits at least two disadvantages. First of all, since the entire length of one side of the extrusion or drawbench must be open to permit lateral exit of the drawn stock, the general cross-section of the bench frame must be of an inverted "L" configuration. Such a configuration requires substantial bracing to provide sufficient rigidity to the drawbench in order to assure accurate operation and extended service life. Because of this, a lateral discharge bench may contain bracing structure and thus material and weight substantially in excess of a bench having a symmetrical, inverted "U" frame cross-section. Secondly, as the stock is laterally discharged from the extrusion apparatus or drawbench, it stacks randomly in a receiving bin and the stock becomes intertwined. Such intertwining or "jackstrawing" complicates emptying of the collection bin as well as orderly handling and packaging of the stock.

SUMMARY OF THE INVENTION

The instant invention comprehends an axial discharge mechanism which receives freshly drawn or extruded stock from a drawbench or an extrusion press and discharges same axially from one end of the drawing or extruding apparatus. The frame of the drawing or extruding apparatus comprises a plurality of inverted "U" frames which support horizontal tracks along which a draw carriage travels to effect the drawing of metal stock according to conventional practice.

The invention may also be practiced in conjunction with extruding apparatus in which case an extruding die and suitable driving apparatus are disposed at one end of the frame. Disposed below and generally aligned vertically with the freshly drawn or extruded stock is a plurality of shiftable stock receiving forks which may be selectively moved between an upper, stock receiving position and a lower, stock discharging position. Disposed generally below the plurality of forks and aligned vertically with the axes of the freshly drawn material is a plurality of power driven rollers.

In operation, metal stock to be drawn is positioned appropriately on the drawbench and secured within the jaws of the draw carriage. Horizontal traverse of the draw carriage effects drawing and area reduction of the metal stock. At the completion of the draw carriage traverse, the stock receiving forks are in their upper, stock receiving position and the drawn stock falls thereinto. The forks define relatively wide openings which taper to a narrow throat and align the drawn stock with stock receiving grooves or channels in the rollers disposed therebelow. Movement of the stock receiving forks from their receiving to their discharging position is accomplished in unison. As noted, the rollers rotate and their rotation drives the drawn stock axially outwardly from one end of the drawbench into appropriate receiving means. The discharge operation may, of course, be accomplished simultaneously with the return of the draw carriage to the starting position for acceptance of the next metal stock to be drawn. When the freshly drawn stock has cleared the drawbench, i.e., has been completely discharged from the plurality of rollers, the stock receiving forks are returned to their upper, stock receiving position, and the operation may be repeated.

It is thus an object of the instant invention to provide a drawbench which discharges drawn stock axially from one end.

It is a further object of the instant invention to provide a drawbench which discharges material axially and thus minimizes jackstrawing of such material.

It is a still further object of the instant invention to provide a drawbench having axial discharge wherein the drawbench vertical supports an inverted "U" cross-section.

Further objects and advantages of the instant invention will be readily apparent by reference to the following specification when considered in the light of the accompanying drawings.

DESCRIPTION OF THE PREFERRED EMBODIMENT

Figure 1:
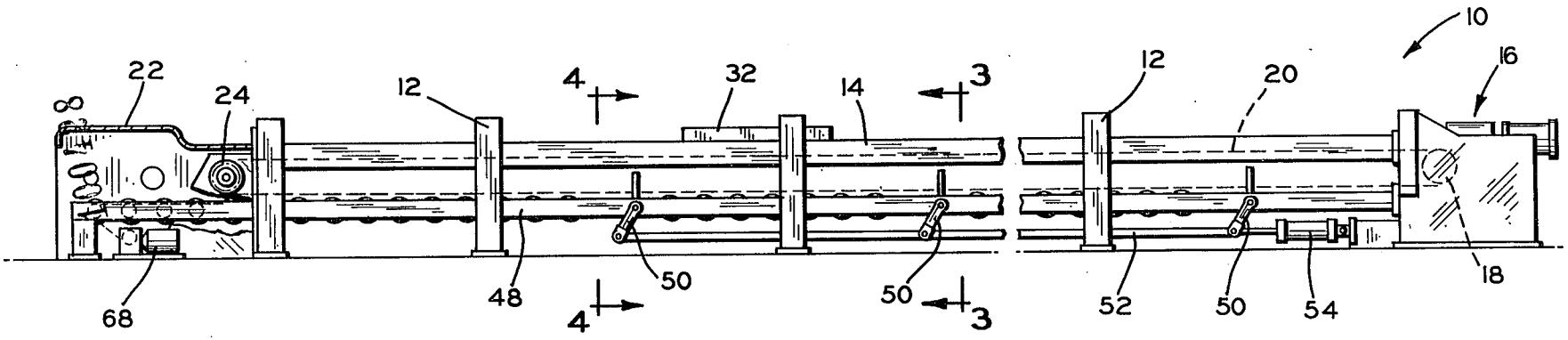
FIG. 1 is a side elevational view of a drawbench incorporating the features of the instant invention.

Referring now to FIG. 1, a drawbench incorporating the axial discharge mechanism of the instant invention is generally designated by the reference numeral 10. The drawbench 10 comprises a plurality of spaced apart support frames 12. The frames 12 generally define inverted U-shaped structures having right angle corners. The frames 12 may be fabricated of steel box beams, I-beams, or similar appropriately rigid structural members having relatively high strength-to-weight ratios. The frames 12 support a pair of horizontal compression beams 14 which extend the full length of the drawbench 10. The compression beams 14 may also be fabricated of suitable steel box beams or similar structural members. At one end of the drawbench 10 is disposed a loading mechanism 16. The loading mechanism 16 comprises a support structure for at least one die (not illustrated) through which the metal stock is drawn and may include push pointer means (not illustrated) which assist the loading of the metal stock into the die and initiates the drawing operation. The loading mechanism 16 further includes a pair of chain sprockets 18 which function as idlers for a pair of endless draw chains 20 which are deployed along the full length of the left and right sides of the drawbench 10. At the end of the drawbench 10 opposite the loading mechanism 16 is disposed a drive unit 22. The drive unit 22 comprises a prime mover such as an electric motor (not illustrated) which drives a pair of sprockets 24 through a suitable gear reduction mechanism (not illustrated) according to conventional drawbench practice. The drive sprockets 24 engage and positively drive the pair of chains 20.

Figure 3:
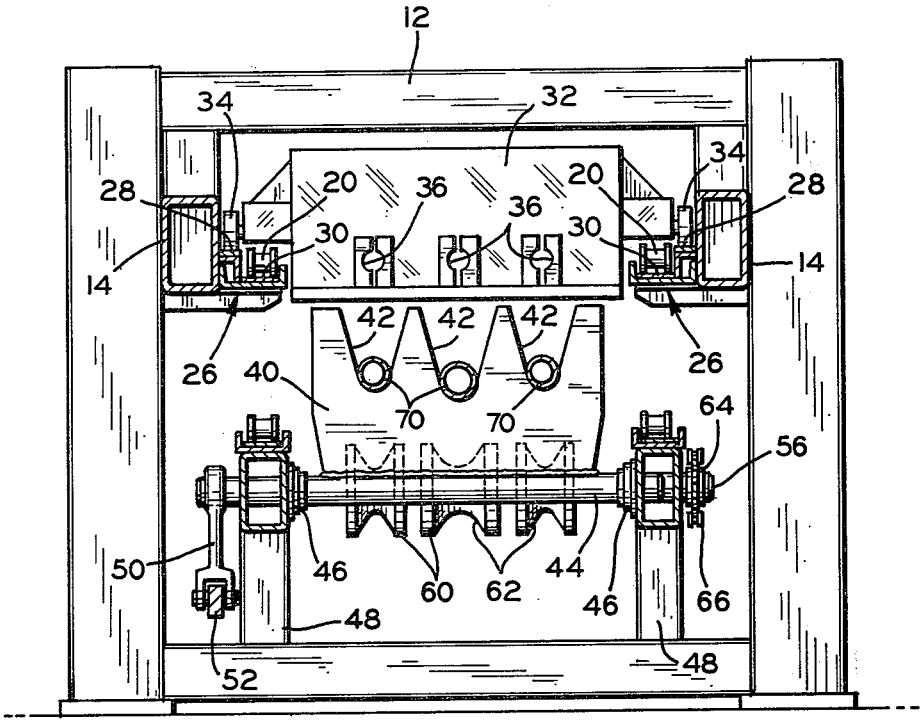
FIG. 3 is a sectional view of the drawbench illustrated in FIG. 1 taken along line 3—3 thereof and showing the stock receiving forks in their upper, stock receiving positions.

Referring now to FIGS. 1 and 3, the compression beams 14 which extend the length of the drawbench 10 provide mounting and support for a pair of mirror-image stepped rails 26. Each of the stepped rails 26 defines an upper horizontal surface 28 and a lower horizontal surface 30. The upper horizontal surfaces 28 are running tracks for a draw carriage 32. The draw carriage 32 is supported by a plurality of rotatable wheels 34 which rest upon and move along the upper horizontal surfaces 28. The draw carriage 32 is of conventional design and includes a plurality of sets of gripper jaws 36 which are adjustable to tightly engage the stock which is to be drawn by the drawbench 10. In the preferred embodiment, three sets of the gripper jaws 36 are utilized. It should be understood, however, that a greater or lesser number of sets of the gripper jaws 36 may be utilized on the drawbench 10 to simultaneously produce a corresponding number of pieces of drawn stock according to machine parameters and production process considerations which are external to the invention and thus will not be further discussed.

The pair of draw chains 20 are secured to the draw carriage 32 and the drive unit 22 thus moves the chains 20 and translates the carriage 32 along the upper horizontal surfaces 28. The lower horizontal surfaces 30 provide tracks within which the pair of draw chains 20 are carried to preclude sagging of the chains 20 and the resulting tension by eliminating what would otherwise be substantial horizontal unsupported lengths of the chains 20.

The drawbench 10 further includes a plurality of selectably shiftable forks 40. The forks 40 may be typically fabricated of a high strength material such as steel and define a plurality of downwardly and inwardly narrowing throats 42. In the preferred embodiment, three throats 42 are utilized and it should be understood that the number of the throats 42 may be increased or decreased to accomodate the number of drawing stations on the drawbench 10. The forks 40 are each secured to a horizontally disposed shaft 44 which is journalled within suitable bearings 46 which are in turn secured to a subframe 48. One end of each of the shafts 44 extends through the bearings 46 and the subframe 48. Secured to each extension of the shafts 44 is a bell crank 50. Each of the bell cranks 50 is pivotally connected to a linking member 52 which is connected to and driven by a two position actuator 54. The two position actuator 54 moves the linkage member 52, the bell cranks 50 and the forks 40 between a first and a second position. In the first stock receiving position, the forks 40 are erect, as illustrated in FIG. 3, and in the second stock discharging position, the forks 40 are tipped obliquely to an angle approaching the horizontal, as illustrated in FIG. 4.

The two position actuator 54 is preferably pneumatically or hydraulically operated inasmuch as such devices exhibit relatively rapid travel between the two positions, but an electric actuator of suitable design may also be utilized.

Figure 2:
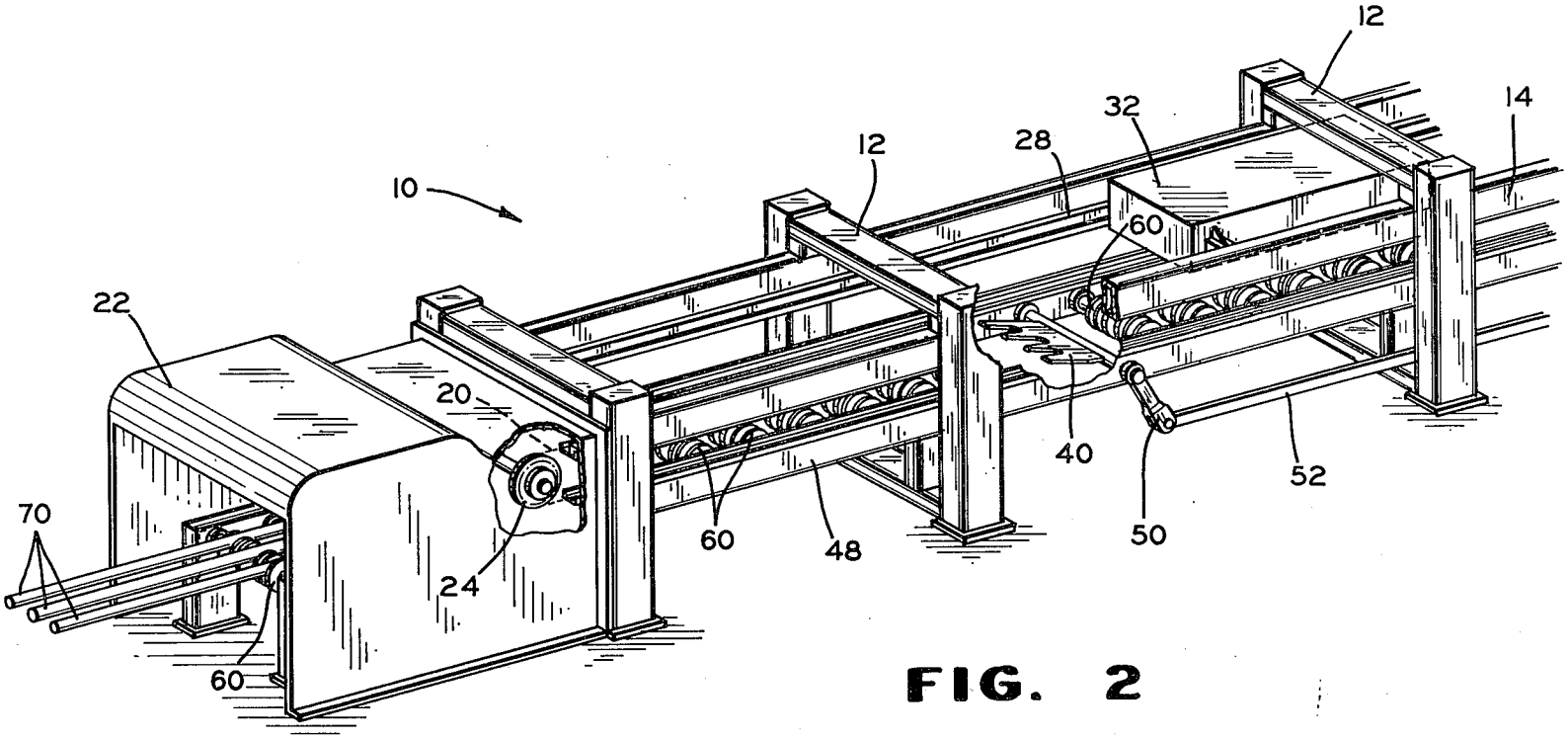
FIG. 2 is a fragmentary perspective view of the drawbench illustrated in FIG. 1 showing drawn stock being axially discharged therefrom.
Figure 4:
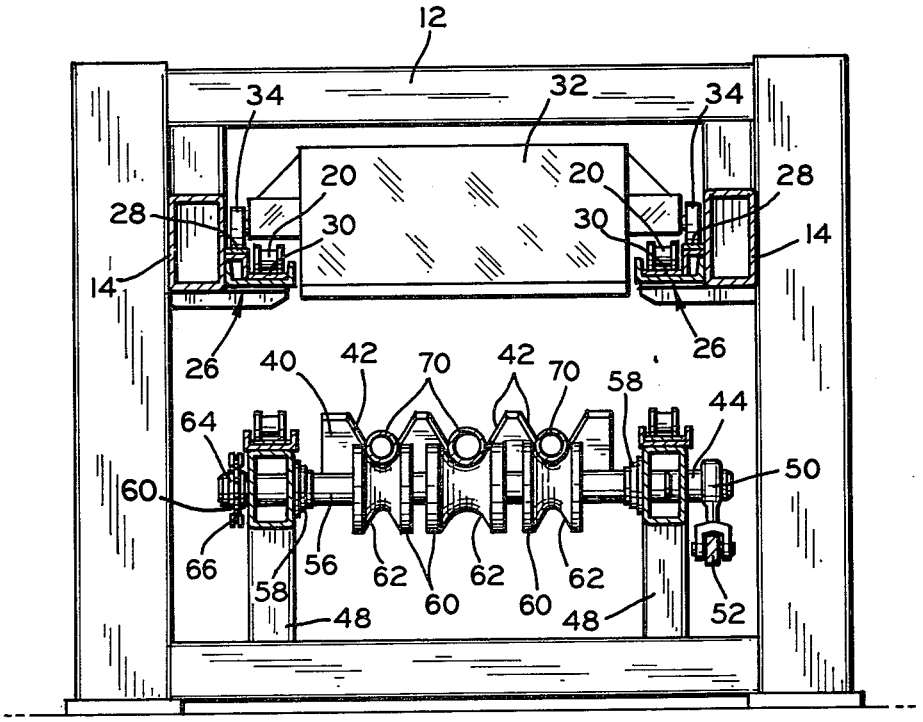
FIG. 4 is a sectional view of the drawbench illustrated in FIG. 1 taken along line 4—4 thereof showing the stock receiving forks in their lower, stock discharging position.

Referring now to FIGS. 1, 2, and 4, the drawbench 10 includes the subframe 48 which extends horizontally along the length of the drawbench 10 from the loading mechanism 16 to the drive unit 22 as previously noted. The subframe 48 supports a second plurality of horizontally disposed shafts 56. The shafts 56 are mounted for rotation in journal bearings 58 or other suitable bearings, such as anti-friction bearings, which are in turn secured to the subframe 48. Secured to each of the shafts 56 is at least one end, in the preferred embodiment, three rollers 60. Each of the rollers 60 preferably includes a circumferential reentrant groove or channel 62. As is apparent from the illustrations of the preferred embodiment, the three rollers 60 utilized therein are distinct structures which do permit lateral adjustment and securement to the shafts 56 relative to them and to one another. In the alternative, a wide unitary roller having appropriate circumferential grooves may be utilized on each of the shafts 56. One end of each of the shafts 56 extends through the journal bearings 58 and the subframe 48. To each of these extensions of the shafts 56 is secured a chain drive sprocket 60. A roller drive chain 66 extends generally along the drawbench 10 and engages all of the chain drive sprockets 60. A chain drive assembly 68, disposed at one end of the drawbench 10, includes a prime mover such as an electric motor and a gear reduction mechanism having an output shaft with a drive sprocket affixed thereto which drives the chain 66, thereby transferring rotary energy from the chain drive assembly 68 to the shafts 56 and the rollers 60.

Operation of the drawbench 10 will now be described with reference to the structure herein before described and illustrated in the drawings. The drawing operation is cyclical; therefore, one complete cycle of the drawing operation will be described with the understanding that such operating cycles will be repeated at a rate dependent upon several machine and process parameters. Faster operating cycles will be associated with drawing material having shorter overall length of smaller cross-sections; whereas, longer operating cycles will generally be associated with drawing of longer lengths of material having larger cross-sectional areas.

The draw carriage 32 is moved to the right as viewed in FIG. 1 and positioned adjacent the loading mechanism 16. At this time, forks 40 are disposed in their upper stock receiving positions as illustrated in FIGS. 1 and 3. Lengths of stock 70 to be drawn is axially aligned with the drawbench 10 and specifically the drawing die which forms a portion of the loading mechanism 16. The stock 70 is moved through the drawing die by the push pointer which also forms a portion of the loading mechanism 16 and is engaged by and tightly retained in the gripper jaws 36 of the draw carriage 32. The drive unit 22 is then activated and the draw carriage 32 is moved horizontally along the upper horizontal tracks 28 and the drawing operation thereby accomplished. As the end or ends of the drawn stock 70 passes through the drawing die, drawing tension on the stock is rapidly released causing the freshly drawn stock 70 to lurch toward the draw carriage 32. This motion releases the gripper jaws 36 and the freshly drawn stock 70 falls into the throats 42 of the forks 40. The disposition of the drawbench 10 and the drawn stock 70 is now as illustrated in FIG. 3.

Next, the two position actuator 54 is activated to shift the forks 40 to their second, stock discharging position. At this time, the draw carriage 32 and, specifically, the drive unit 22 may be reversed to return the draw carriage 32 to its position adjacent the loading mechanism 16 in order to receive additional stock. In their lower, stock discharging position, the throats 42 of the forks 40 are positioned slightly below the channels 62 in the rollers 60 and thus the drawn stock 70 seats in the channels 62 and is translated axially by the rotation of the rollers 60. FIG. 4 illustrates the discharging step.

Referring briefly to FIG. 2, the rollers 60 translate the drawn stock 70 axially out one end of the drawbench 10. A suitable receiving table or bin (not illustrated) receives and stores the drawn stock 70 until appropriate transportation of the stock is available or required.

It should be understood that notwithstanding the fact that in the preceding specification, the invention has been described in relation to a drawbench, it should be understood that it is equally well suited for incorporation into extruding presses and all similar equipment which produces individual lengths of relatively rigid material such as metal, wood, plastic and the like.

The foregoing disclosure is the best mode devised by the inventors for practicing this invention. It is apparent, however, that methods incorporating modifications and variations to the instant invention will be obvious to one skilled in the art of drawbenches. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A horizontal, longitudinally extending drawbench for producing lengths of stock material, comprising:

(a) a longitudinally extending frame having a longitudinal axis;

(b) a draw carriage longitudinally movably mounted on said frame for drawing said stock material from a shaping die and releasing the lengths of stock material;

(c) a longitudinally movable conveying means disposed directly beneath said draw carriage to move released lengths of stock material parallel with the longitudinal axis of said frame; and (d) means disposed beneath said draw carriage in alignment with said conveying means for receiving and transferring the released lengths of stock material onto said conveying means.

2. The invention defined in claim 1 wherein said stock receiving and transferring means comprises at least a pair of longitudinally spaced, transversely extending members and, said conveying means comprises a series of longitudinally spaced, transversely extending rollers, said pair of receiving and transferring members being disposed between adjacent pairs of conveying rollers and pivotal between a first stock receiving position and a second stock transferring position.

3. The invention defined in claim 2 wherein each member of said pair of stock receiving-transferring members includes means for aligning the stock material with said conveying means and said conveying rollers includes means for maintaining the stock material in longitudinal alignment with said conveying means.

4. The invention defined in claim 3 wherein said aligning means of each member of said pair of stock receiving-transferring members comprises an upwardly and outwardly tapering slot and said conveying rollers each include a circumferential groove in alignment with the slots in each said stock receiving and transfer member.

5. The invention defined in claim 2 including an actuator for pivotally moving said pair of stock receiving and transferring members in unison between said first and said second positions.

* * * * *